US009397395B2

(12) United States Patent
Boutayeb

(10) Patent No.: US 9,397,395 B2
(45) Date of Patent: Jul. 19, 2016

(54) ELECTRONICALLY STEERABLE ANTENNA USING RECONFIGURABLE POWER DIVIDER BASED ON CYLINDRICAL ELECTROMAGNETIC BAND GAP (CEBG) STRUCTURE

(71) Applicant: Huawei Technologies Co., Ltd., Shenzhen (CN)

(72) Inventor: Halim Boutayeb, Montreal (CA)

(73) Assignee: Huawei Technologies Co., Ltd., Shenzhen (CN)

( * ) Notice: Subject to any disclaimer, the term of this patent is extended or adjusted under 35 U.S.C. 154(b) by 713 days.

(21) Appl. No.: 13/760,980

(22) Filed: Feb. 6, 2013

(65) Prior Publication Data

US 2014/0218237 A1 Aug. 7, 2014

(51) Int. Cl.

| | |
|---|---|
| ***H01Q 3/02*** | (2006.01) |
| ***H01Q 3/00*** | (2006.01) |
| ***H01Q 13/00*** | (2006.01) |
| ***H01Q 3/24*** | (2006.01) |
| ***H01Q 15/00*** | (2006.01) |

(52) U.S. Cl.

CPC ..... *H01Q 3/247* (2013.01); *H01Q 3/24* (2013.01); *H01Q 13/00* (2013.01); *H01Q 15/006* (2013.01)

(58) Field of Classification Search

CPC ..... H01Q 3/24; H01Q 3/26
USPC ..... 342/81, 154, 368, 373, 374; 343/771, 343/777

See application file for complete search history.

(56) References Cited

U.S. PATENT DOCUMENTS

| | | | | |
|---|---|---|---|---|
| 3,852,761 | A * | 12/1974 | Bogner | 343/754 |
| 7,636,070 | B2 | 12/2009 | De Lustrac et al. | |
| 2003/0184476 | A1* | 10/2003 | Sikina et al. | 343/700 MS |

FOREIGN PATENT DOCUMENTS

| | | | |
|---|---|---|---|
| CN | 102694231 | A | 9/2012 |
| CN | 102832432 | A | 12/2012 |
| JP | 2000196350 | A | 7/2000 |

OTHER PUBLICATIONS

Boutayeb, H., et al., "Analysis and Design of a Cylindrical EBG-based Directive Antenna," IEEE Transactions on Antennas and Propagation, vol. 54, No. 1, Jan. 2006, pp. 211-219.

Boutayeb, H., et al., "Analysis of Radius-Periodic Cylindrical Structures," IEEE Antennas and Propagation Society International Symposium, vol. 2, Jun. 22-27, 2003, pp. 813-816.

(Continued)

*Primary Examiner* — Dao Phan
(74) *Attorney, Agent, or Firm* — Slater Matsil, LLP

(57) ABSTRACT

A low complexity/cost beamsteering antenna includes a central line feed affixed to a radial waveguide structure, radiating elements positioned along the circumference of the radial waveguide structure, and a plurality of active elements interspersed along the surface of the radial waveguide structure between the central line feed and the radiating elements. The active elements may comprise PIN diodes or microelectromechanical system (MEMS) components, and may be selectively activated/deactivated by DC switches in order to direct the propagation of an RF signal over the radial waveguide structure in a manner similar to a power divider. As a result, the RF signal may be funneled to selected radiating elements, thereby effectively directionally aiming the main lobe of the emitted radiation pattern to beamsteer the wireless transmission.

19 Claims, 7 Drawing Sheets

(56) References Cited

OTHER PUBLICATIONS

Boutayeb, H., "Étude des Structures Périodiques Planaires et Conformes Associées aux Antennes. Application aux Communications Mobiles.," Ph. D. Thesis, Présentée Devant L'Université de Rennes 1, IETR, Groupe Antennes et Hyperfréquences UMR CNRS 6164, Campus de Beaulieu, Dec. 12, 2003, (with English Abstract) 272 pages.

Boutayeb, H., et al., "Metallic Cylindrical EBG Structures with Defects: Directivity Analysis and Design Optimization," IEEE Transactions on Antennas and Propagation, vol. 55, No. 11, Nov. 2007, pp. 3356-3361.

Boutayeb, H., et al., "A Reconfigurable Electromagnetic Band Gap Structure for a Beam Steering Base Station Antenna," 27th ESA Antenna Technology Workshop on Innovative Periodic Antennas, Jan. 2004, 7 pages.

Boutayeb, H., et al., "Wide-band CEBG-based Directive Antenna," 2007 IEEE Antennas and Propagation Society International Symposium, Jun. 9-15, 2007, pp. 2909-2912.

Bouyateb, H., et al., "Technique for Reducing the Power Supply in Reconfigurable Cylindrical Electromagnetic Band Gap Structures," IEEE Antennas and Wireless Propagation Letters, vol. 5, No. 1, Dec. 2006, pp. 424-425.

International Search Report and Written Opinion receivedin International Application No. PCT/CN2014/071877 mailed May 13, 2014, 12 pages.

* cited by examiner

ELECTRONICALLY STEERABLE ANTENNA USING RECONFIGURABLE POWER DIVIDER BASED ON CYLINDRICAL ELECTROMAGNETIC BAND GAP (CEBG) STRUCTURE

TECHNICAL FIELD

The present invention relates generally to electronically steerable antenna using reconfigurable power divider based on cylindrical electromagnetic band gap (CEBG) structure.

BACKGROUND

Modern wireless transmitters perform beamsteering to manipulate the direction of a main lobe of a radiation pattern and achieve enhanced spatial selectivity. Conventional beamsteering techniques rely on manipulating the phase of radio frequency (RF) signals through a series of phase shifters and RF switches. The inclusion of phase shifters, RF switches, and other complex components increase the manufacturing cost and design complexity of agile antennas. Accordingly, less complex agile antenna designs are desired.

SUMMARY OF THE INVENTION

Technical advantages are generally achieved, by embodiments of this disclosure which describe electronically steerable antenna using reconfigurable power diver based on cylindrical electromagnetic band gap (CEBG) structure.

In accordance with an embodiment, an apparatus for transmitting wireless signals is provided. In this example, the apparatus includes a central line feed; and a radial waveguide structure coupled to the central line feed. The radial waveguide structure comprises a plurality of radiating elements encircling the central line feed, and a plurality of active elements interspersed between the central line feed and the plurality of radiating elements.

In accordance with another embodiment, a method for operating an agile antenna is provided. The agile antenna has a radial waveguide structure affixed to a central line feed. Further, a plurality of active elements are affixed to the surface of the radial waveguide structure, and a plurality of radiating elements are positioned along the circumference of the radial waveguide structure. In this example, the method comprises emitting, from the central line feed, a radio frequency (RF) signal over the radial waveguide structure, and selectively activating fewer than all of the plurality of active elements to direct the propagation of the RF signal towards fewer than all of the radiating elements, thereby beamsteering a wireless signal emitted by the agile antenna.

In accordance with yet another embodiment, an antenna configured for beam switching is provided. In this example, the antenna includes a line feed configured to emit a radio frequency (RF) signal, a plurality of radiating elements encircling the line feed, and a plurality of active elements interspersed between the line feed and the plurality of radiating elements. The plurality of radiating elements are configured to convert the RF signal into a wireless signal.

BRIEF DESCRIPTION OF THE DRAWINGS

For a more complete understanding of the present disclosure, and the advantages thereof, reference is now made to the following descriptions taken in conjunction with the accompanying drawings, in which.

Corresponding numerals and symbols in the different figures generally refer to corresponding parts unless otherwise indicated. The figures are drawn to clearly illustrate the relevant aspects of the embodiments and are not necessarily drawn to scale.

DETAILED DESCRIPTION OF ILLUSTRATIVE EMBODIMENTS

The making and using of embodiments of this disclosure are discussed in detail below. It should be appreciated, however, that the concepts disclosed herein can be embodied in a wide variety of specific contexts, and that the specific embodiments discussed herein are merely illustrative and do not serve to limit the scope of the claims. Further, it should be understood that various changes, substitutions and alterations can be made herein without departing from the spirit and scope of this disclosure as defined by the appended claims.

Disclosed herein is an agile antenna that beamsteers wireless transmissions by selectively activating/de-activating active elements on a radial-waveguide using direct current (DC) switches. Notably, the active elements may be relatively low complexity and/or inexpensive active/electromechanical components (e.g., diodes, microelectromechanical system (MEMS), etc.), and hence embodiment agile antenna designs of this disclosure may achieve cost and/or complexity savings over conventional agile antenna designs that rely on phase shifters and radio frequency (RF) switches to effectuate beamsteering. More specifically, embodiment agile antennas include a plurality of radiating elements encircling a radial waveguide upon which a plurality of active elements are affixed. The active elements may be activated/deactivated by DC switches in order to direct the propagation of an RF signal across the waveguide and towards selected radiating elements, thereby determining the primary direction of the main lobe of the emitted radiation pattern.

U.S. Patent Application Publication 2007/0080891 (hereinafter "the '891 Application") discusses an agile antenna that uses a circular via configuration to effectuate beamsteering, and is incorporated herein by reference as if reproduced in its entirety. The agile antenna design discussed in the '891 Application utilizes a dipole feed design in which propagation of the RF signal is directed via a series of parasitic reflectors and radiators towards a centralized radiating element. As a result, the agile antenna provided by the '891 Application is only capable of vertical polarization, and is limited to azimuth beam direction coverage. Conversely, embodiment agile antennas provided herein utilize a coaxial feed line, and as well as a series of inter-connected active elements (acting like a power divider) to direct the RF signal towards selected radiating elements positioned along the circumference of the radial waveguide. As a result of these (and other) design principals, embodiment agile antennas described herein are capable of achieving various polarizations (e.g., single, dual, circular, elliptical, etc.) as well as achieving full beam coverage. This flexibility is achieved thanks to the freedom of choice of the radiator element in the design principle.

Figure 1:
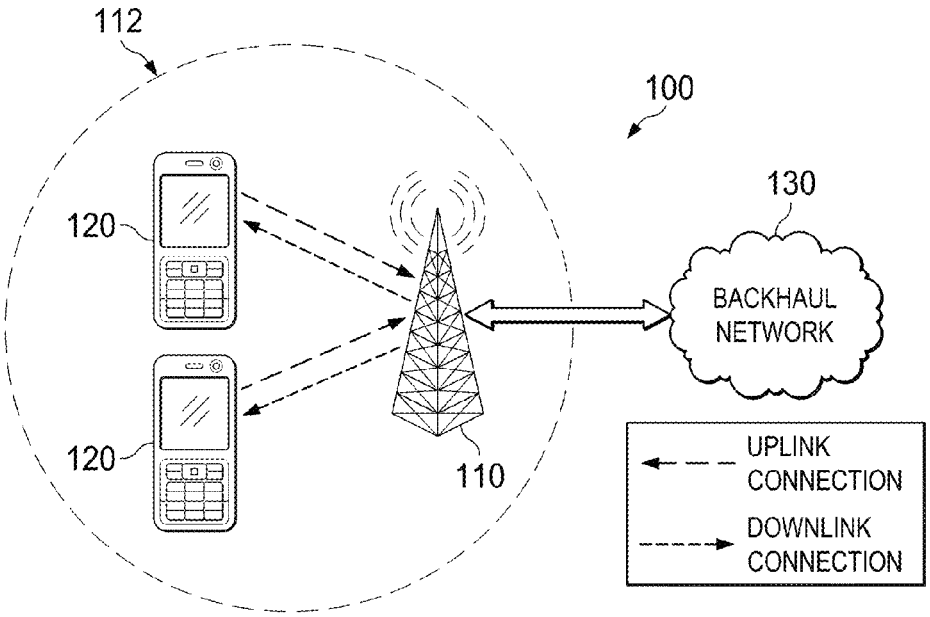
FIG. 1 illustrates a diagram of a wireless network for communicating data.

FIG. 1 illustrates a network 100 for communicating data. The network 100 comprises an access point (AP) 110 having a coverage area 112, a plurality of user equipments (UEs) 120, and a backhaul network 130. The AP 110 may comprise any component capable of providing wireless access by, inter alia, establishing uplink (dashed line) and/or downlink (dotted line) connections with the UEs 120, such as a base station, an enhanced base station (eNB), a femtocell, and other wirelessly enabled devices. The UEs 120 may comprise any components capable of establishing a wireless connection with the AP 110. The backhaul network 130 may be any component or collection of components that allow data to be exchanged between the AP 110 and a remote end (not shown). In some embodiments, the network 100 may comprise various other wireless devices, such as relays, femtocells, etc.

Figure 2:
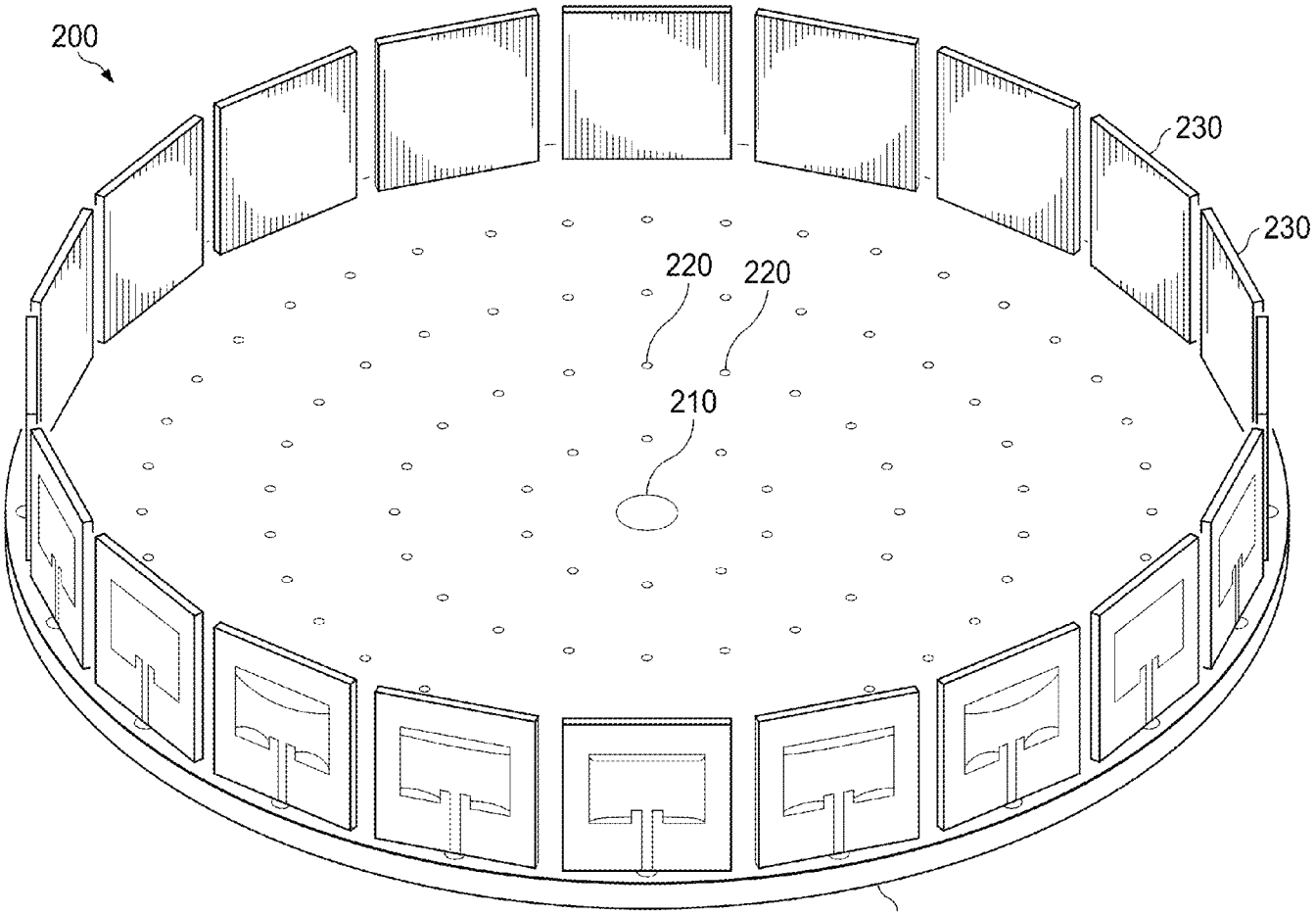
FIG. 2 illustrates a diagram of an embodiment agile antenna.

FIG. 2 illustrates an agile antenna 200 comprising a radial waveguide structure 205, a line feed 210, a plurality of active elements 220, and a plurality of radiating elements 230. The active elements 220 may be any component or collection of components that has the ability to (collectively or independently) change the flow of current over the radial waveguide structure 205. In an embodiment, active elements include active components that rely on a source of energy (e.g., DC power) to change the flow of current, such as (for example) a PIN diode. In the same or other embodiments, active elements include electromechanical components that change the flow of current using moving parts or electrical connections, such as (for example) MEMS components. As shown, the line feed 210 protrudes from the center of the radial waveguide structure 205, the radiating elements 230 are affixed around the circumference of the radial waveguide structure 205, and the active elements 220 are affixed to the surface of the radial waveguide structure 205. The line feed 210 emits an RF electrical signal, which radiates outwardly over the radial waveguide structure 205. The active elements 220 are interspersed between the line feed 210 and the radiating element 230, and may be selectively activated/deactivated for the purpose of directing propagation of the RF signal towards selected ones of the plurality of radiating elements 230.

Figure 3:
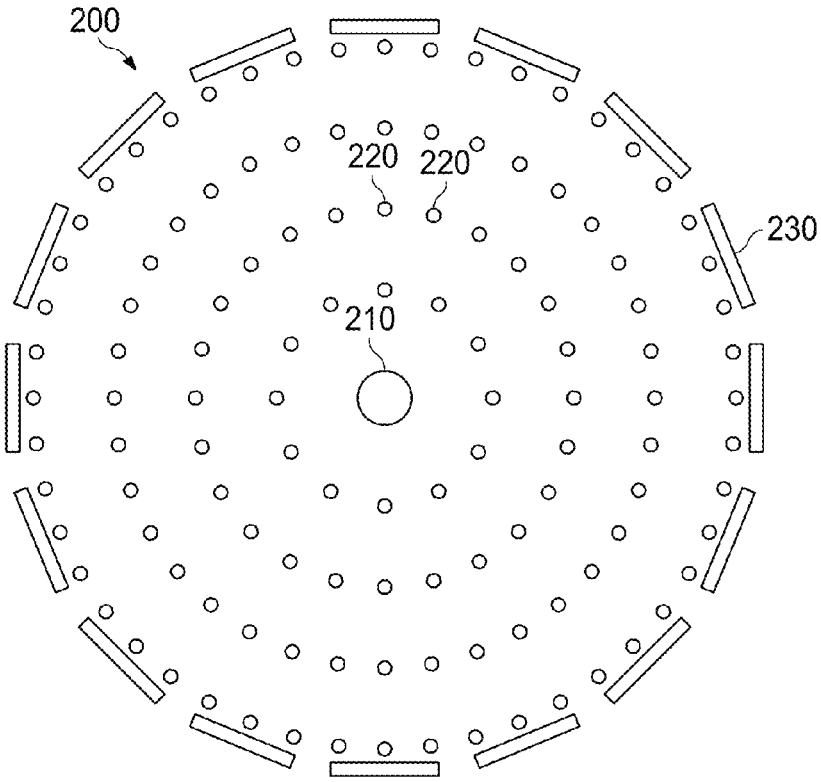
FIG. 3 illustrates a top view of the embodiment agile antenna.
Figure 4:
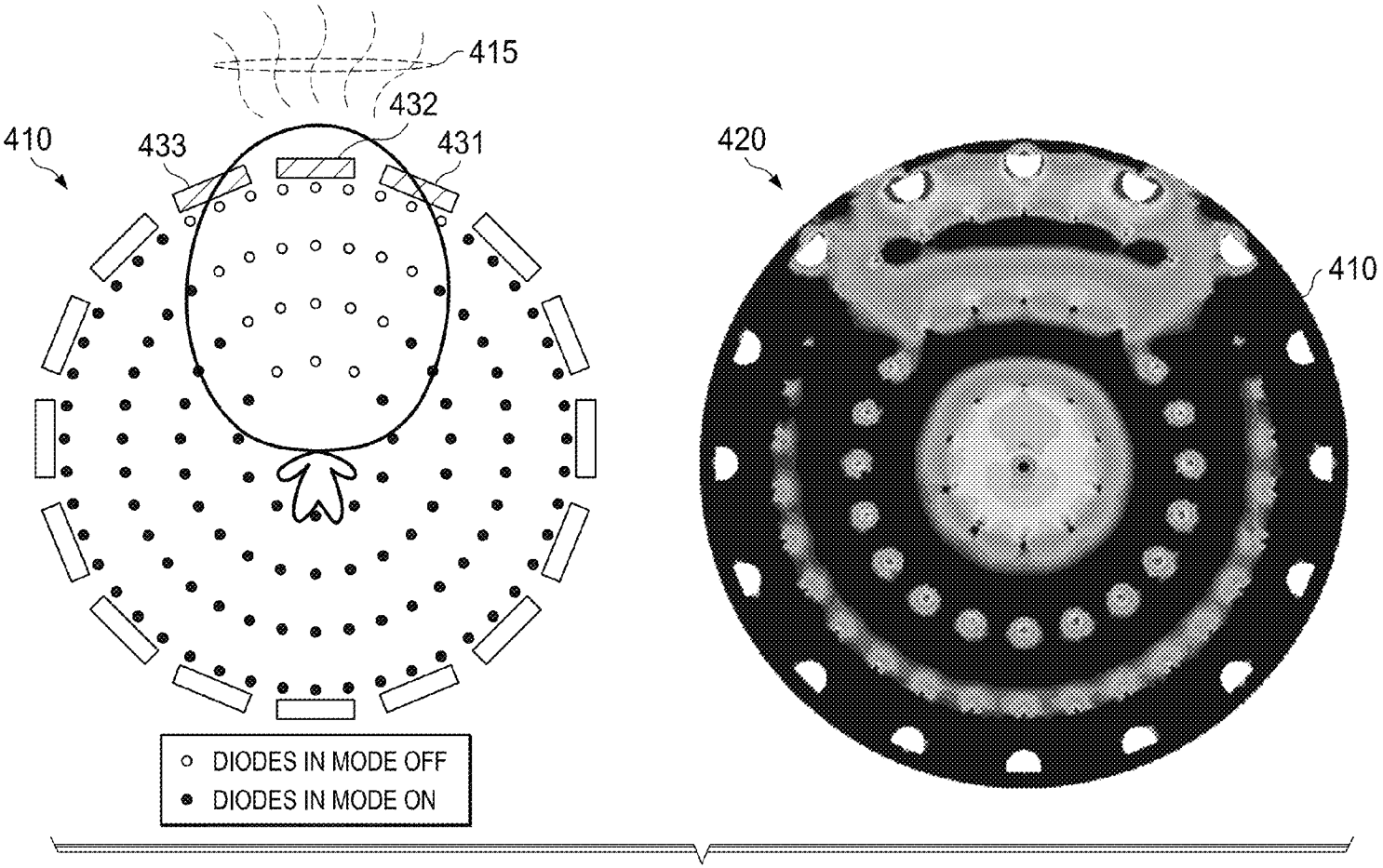
FIG. 4 illustrates a diagram of an embodiment agile antenna configured to emit a beamsteered wireless signal.

FIG. 3 illustrates a top view of the agile antenna 200 illustrating how the diodes 220 encircle the coaxial line feed 210. Notably, different patterns of the active elements 220 are activated to direct the RF signal towards different radiating elements 230, which effectively beamsteers the wireless transmission. FIG. 4 illustrates a top view of an agile antenna 410 configured to emit a wireless signal 415. As shown, selected active elements are activated/de-activated to direct propagation of the RF signal towards the radiating elements 431-433, which controls the direction of the wireless signal 415. Notably, whether a given RF signal propagates over active elements in the "On Mode" (e.g., activated diodes, etc.) or in the "Off Mode" (e.g., deactivated diodes, etc.) may depend on the wavelength of the RF signal. For instances, RF wavelengths within a certain range propagate over activated diodes, while RF wavelengths outside that range propagate over de-activated diodes. The diagram 420 shows the radiation pattern of the agile antenna 410.

Figure 5:
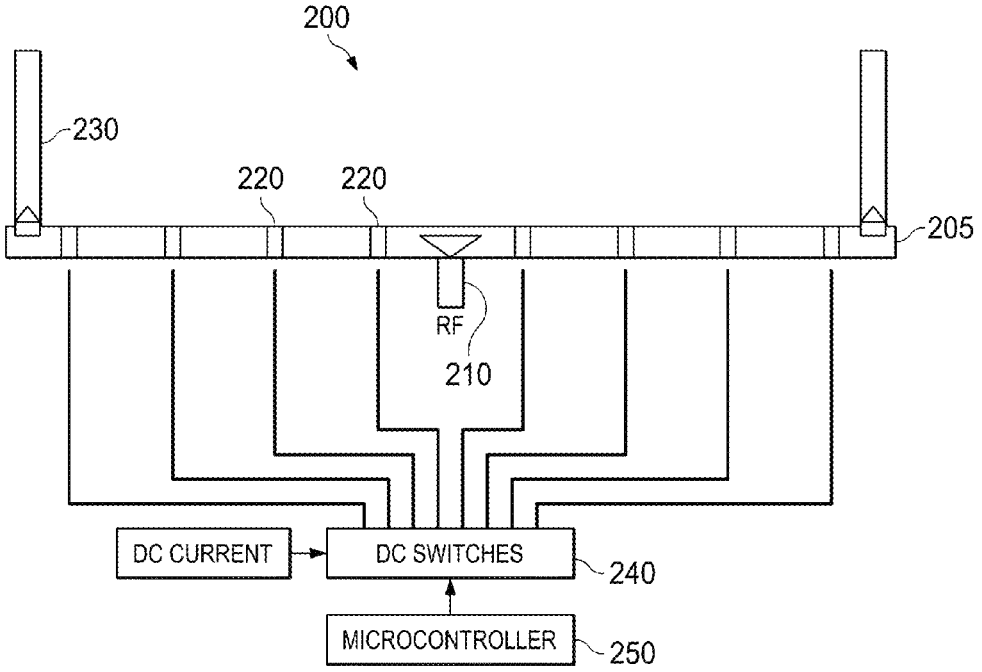
FIG. 5 illustrates a side view of the embodiment agile antenna.

Notably, embodiment agile antennas constructed in accordance with embodiments of this disclosure utilize direct current (DC) switches, and therefore are less complex than conventional agile antennas (which rely on phase shifters and RF switches to effectuate beamsteering). FIG. 5 illustrates a side view of the agile antenna 200. As shown, the diodes 220 are controlled by a microcontroller 250 via a series of DC switches 240. Notably, beamsteering related processing in the agile antenna 200 may be akin to manipulating a power divider, and therefore may be far less complex than the baseband processing (e.g., computing phase/amplitude shifts, etc.) inherent to conventional agile antennas. As a result, the microcontroller 250 may be of lower complexity and consume less power than the processors included in conventional agile antenna designs.

Figure 6:
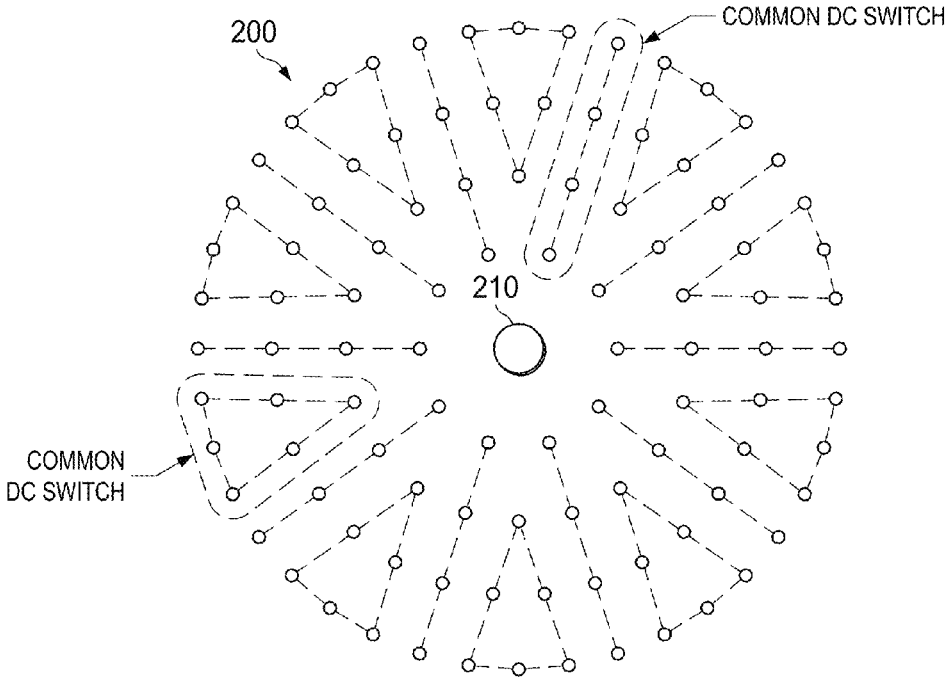
FIG. 6 illustrates a diagram of an embodiment agile antenna comprising groups of active elements that are controlled by a common switch.

In some configurations, the number of DC switches required to effectuate beamsteering is reduced by using a common switch to activate groups of active elements. FIG. 6 illustrates a diagram showing how groups of active elements 220 in the agile antenna 200 can be controlled by a common switch. As shown in FIG. 6, groups of active elements 220 (as indicated by the dashed lines) are controlled by the same switch such that fewer switches (e.g., twenty switches in FIG. 6) are used to control beamsteering.

Figure 7:
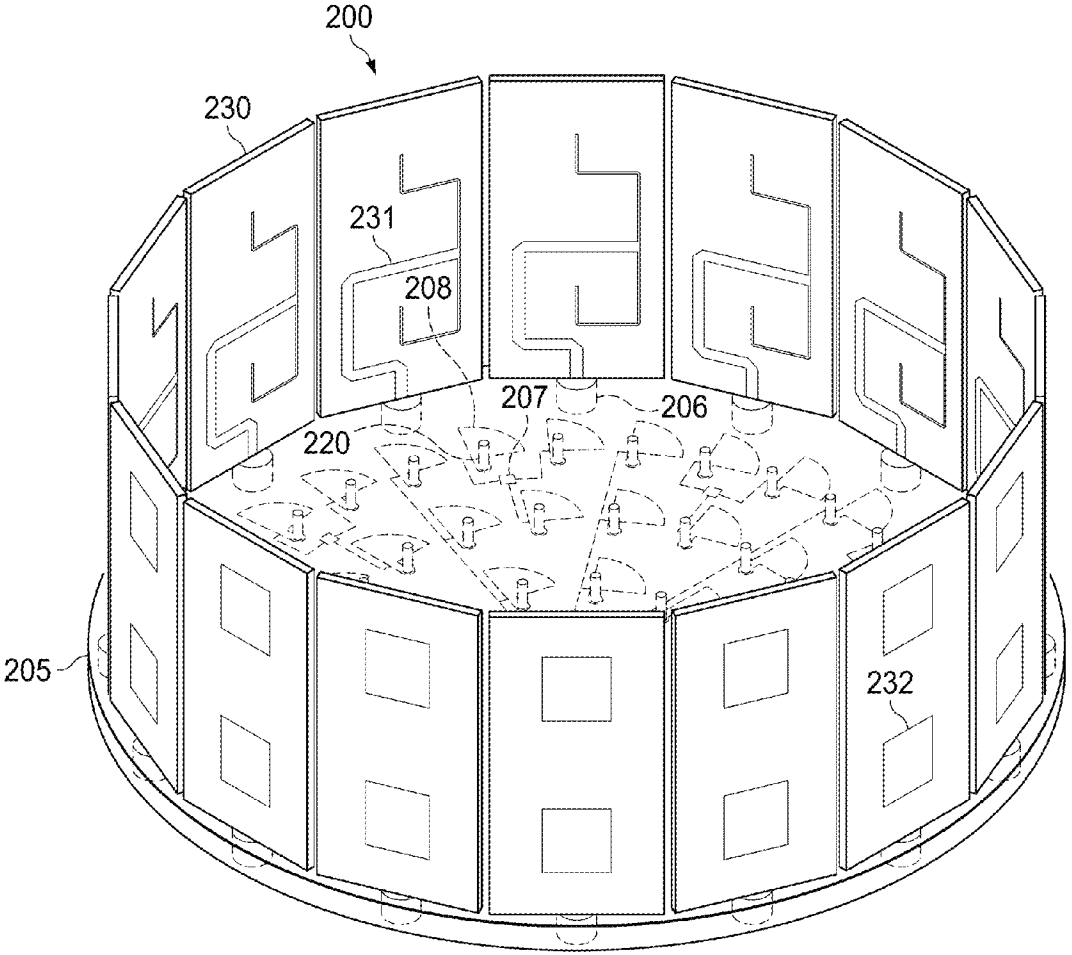
FIG. 7 illustrates a diagram of another embodiment agile antenna.
Figure 8:
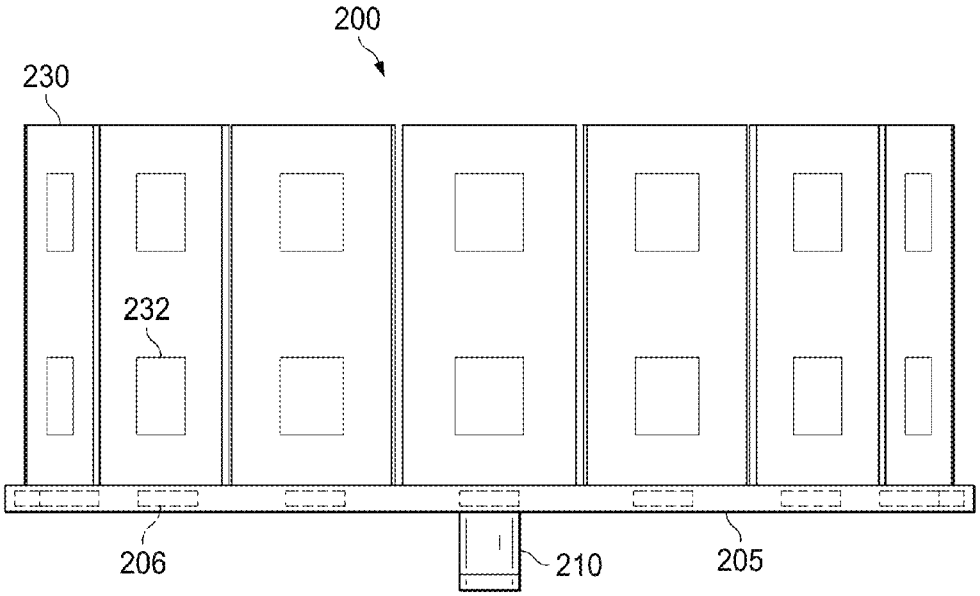
FIG. 8 illustrates another side view of the embodiment agile antenna.
Figure 9:
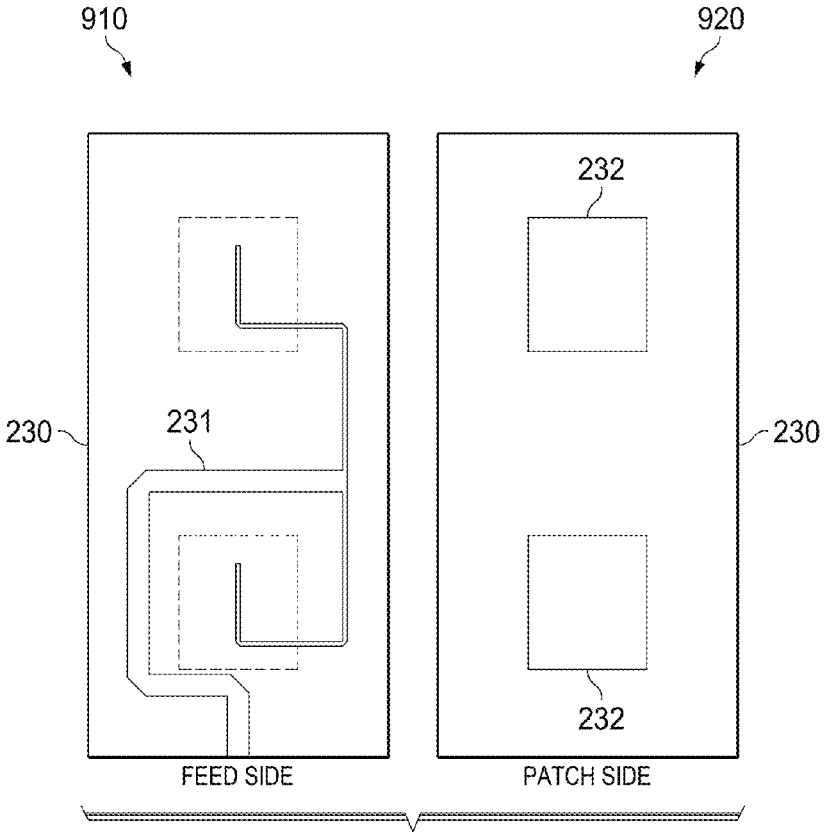
FIG. 9 illustrates a diagram of a radiating element.
Figure 10:
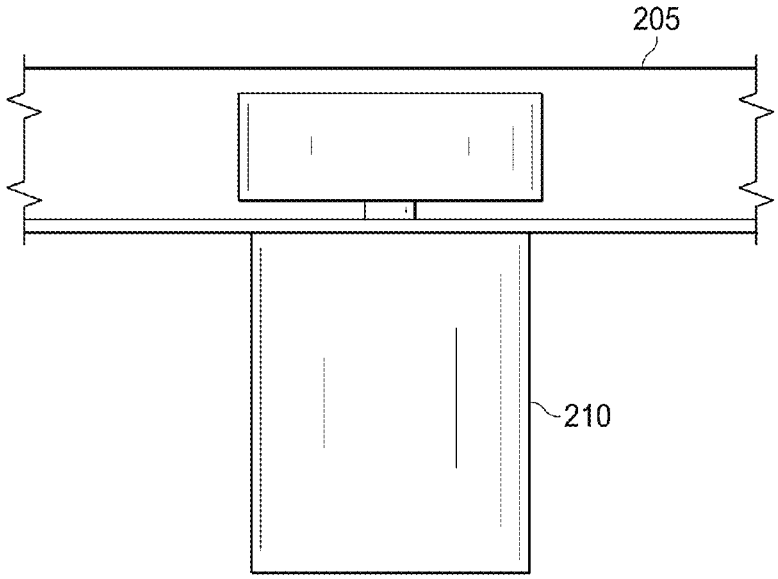
FIG. 10 illustrates a diagram of an interconnection between the coaxial line feed and a radial waveguide.

FIG. 7 illustrates the agile antenna 200 in greater detail than FIG. 2. As shown, the radial waveguide structure 205 includes transitional elements 206, DC feed circuits 207, and RF chokes 208. The transitional elements provide a conductive interface to each of the radiating elements 230. The DC feed circuits 207 interconnect groups of active elements 220 to a common ground and/or to a common metallic via, such that DC current can activate/de-active the active elements 220. The RF chokes 208 may include any components configured to block RF frequency signal without blocking the DC signal. Further, the radiating elements 230 may include one or more feed patches 232, which are interconnected to the transitional elements 206 of the radial waveguide structure 205 via a series of conductive feed paths 231. FIG. 8 illustrates a side view of the agile antenna 200. FIG. 9 illustrates a radiating element 230, and demonstrates differences between the feed side 910 and the patch side 920 of the radiating elements 230. As shown, the feed side 910 includes a conductive feed path 231, which feeds the RF signal to the feed patches 232 on the path side 920 of the radiating element 230. FIG. 10 illustrates an interconnection between the coaxial line feed 210 and the radial waveguide 205.

Figure 11:
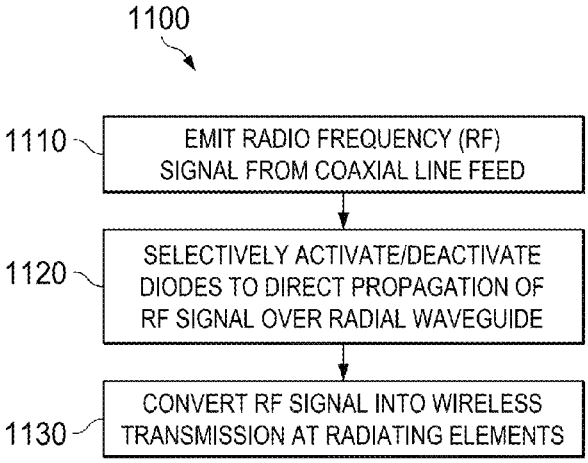
FIG. 11 illustrates a flowchart of a method for transmitting a beamsteered wireless signal.

FIG. 11 illustrates a flowchart 1100 of a method for beamsteering a wireless transmission in accordance with aspects of this disclosure, as might be performed by an agile antenna (or operator thereof). The method 1100 begins at step 1110, where an RF signal is emitted from the coaxial line feed of the agile antenna. Thereafter, the method 1100 proceeds to step 1120, where active elements of the agile antenna are selectively activated/deactivated in order to direct propagation of the RF signal over the radial waveguide. Notably, the RF signal is directed towards selected radiating elements for the purpose of beamsteering the emitted wireless signal. Next, the method 1100 proceeds to step 1130, where the RF signal is converted into a wireless signal by the excited radiating elements.

Figure 12:
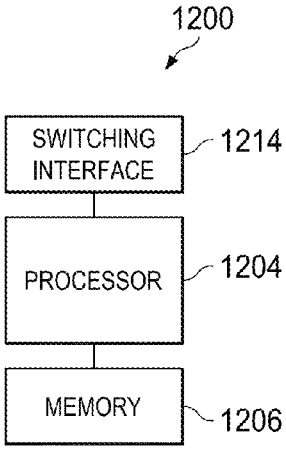
FIG. 12 illustrates a block diagram of an embodiment communications device.

FIG. 12 illustrates a block diagram of an embodiment of a communications device 1200 including a processor 1204, a memory 1206, and a switching interface 1214, which may (or may not) be arranged as shown in FIG. 12. The processor 1204 may be any component capable of performing computations and/or other processing related tasks, and may be equivalent to the microcontroller 250 (discussed above). The memory 1206 may be any component capable of storing programming and/or instructions for the processor 1204. The switching interface 1214 may be any component or collection of components that allows the processor 1204 to manipulate or otherwise control a series of DC switches for the purpose of effectuating beamsteering on an agile antenna.

Although the description has been described in detail, it should be understood that various changes, substitutions and alterations can be made without departing from the spirit and scope of this disclosure as defined by the appended claims. Moreover, the scope of the disclosure is not intended to be limited to the particular embodiments described herein, as one of ordinary skill in the art will readily appreciate from this disclosure that processes, machines, manufacture, compositions of matter, means, methods, or steps, presently existing or later to be developed, may perform substantially the same function or achieve substantially the same result as the corresponding embodiments described herein. Accordingly, the appended claims are intended to include within their scope such processes, machines, manufacture, compositions of matter, means, methods, or steps.

What is claimed:

1. An apparatus comprising:

a central line feed;

a radial waveguide structure coupled to the central line feed, the radial waveguide structure comprising a plurality of radiating elements positioned around the central line feed, and a plurality of active elements interspersed between the central line feed and the plurality of radiating elements, the plurality of active elements excluding phase shifters, wherein the plurality of radiating elements are configured to convert a radio frequency (RF) signal into a wireless signal; and a controller coupled to the active elements, the controller configured to beam-steer the wireless signal by manipulating the active elements.

2. The apparatus of claim 1, wherein the plurality of active elements comprise diodes.

3. The apparatus of claim 1, wherein the plurality of active elements comprise microelectromechanical system (MEMS) components.

4. An apparatus comprising:

a central line feed;

a radial waveguide structure coupled to the central line feed, the radial waveguide structure comprising a plurality of radiating elements positioned around the central line feed, and a plurality of active elements interspersed between the central line feed and the plurality of radiating elements, wherein the plurality of radiating elements are configured to convert a radio frequency (RF) signal into a wireless signal; and a plurality of switches configured to activate/deactivate selected active elements in the plurality of active elements to direct the propagation of the RF signal over the radial waveguide structure, thereby beamsteering the wireless signal.

5. The apparatus of claim 4, wherein the plurality of switches are direct current (DC) switches.

6. The apparatus of claim 1, wherein the RF signal radiates outwardly from the central line feed over the radial waveguide structure towards the radiating elements.

7. The apparatus of claim 1, wherein the central line feed is a coaxial line feed.

8. An antenna configured for beam switching, the antenna comprising:

a line feed configured to emit a radio frequency (RF) signal;

a plurality of radiating elements positioned around the line feed, the plurality of radiating elements configured to convert the RF signal into a wireless signal;

a plurality of active elements interspersed between the line feed and the plurality of radiating elements, the plurality of active elements excluding phase shifters; and a controller coupled to the active elements, the controller configured to beam-steer the wireless signal by manipulating the active elements.

9. The antenna of claim 8, wherein the plurality of active elements comprise diodes.

10. The antenna of claim 8, wherein the plurality of active elements comprise microelectromechanical system (MEMS) components.

11. An antenna configured for beam switching, the antenna comprising:

a line feed configured to emit a radio frequency (RF) signal;

a plurality of radiating elements positioned around the line feed, the plurality of radiating elements configured to convert the RF signal into a wireless signal;

a plurality of active elements interspersed between the line feed and the plurality of radiating elements; and a plurality of switches configured to activate/deactivate selected active elements in the plurality of active elements to direct the propagation of the RF signal, thereby beamsteering the wireless signal.

12. The antenna of claim 11, wherein the plurality of switches are direct current (DC) switches.

13. The antenna of claim 8, wherein the RF signal radiates outwardly from the line feed over a radial waveguide structure towards the radiating elements.

14. The antenna of claim 8, wherein the line feed is a coaxial line feed.

15. The antenna of claim 8, wherein the plurality of radiating elements encircle the line feed.

16. The antenna of claim 8, wherein the line feed is a central line feed.

17. The apparatus of claim 1, wherein the plurality of radiating elements encircle the central line feed.

18. The apparatus of claim 1, wherein the controller beamsteers the wireless signal by activating/deactivating selected active elements in the plurality of active elements to direct the propagation of the RF signal over the radial waveguide structure.

19. The antenna of claim 8, wherein the controller beamsteers the wireless signal by activating/deactivating selected active elements in the plurality of active elements to direct the propagation of the RF signal.

* * * * *